United States Patent [19]

Ateya

[11] Patent Number: 4,493,548

[45] Date of Patent: Jan. 15, 1985

[54] APPARATUS FOR SUPPORTING FLEXIBLE MEMBERS

[75] Inventor: Antoun I. Ateya, Rochester, N.Y.

[73] Assignee: Eastman Kodak Company, Rochester, N.Y.

[21] Appl. No.: 362,435

[22] Filed: Mar. 26, 1982

[51] Int. Cl.[3] ..... G03G 15/20

[52] U.S. Cl. ..... 355/3 FU; 271/195; 355/3 R; 406/88

[58] Field of Search ..... 355/3 R, 3 TR, 3 FU; 406/88; 271/97, 195; 198/811

[56] References Cited

U.S. PATENT DOCUMENTS

| | | |
|---|---|---|
| 3,231,165 | 1/1966 | Wallin et al. . |
| 3,276,425 | 10/1966 | Rabb . |
| 3,405,977 | 10/1968 | Albright . |
| 3,502,407 | 3/1970 | Granzow et al. . |
| 3,506,259 | 4/1970 | Caldwell et al. . |
| 3,614,168 | 10/1971 | Range . |
| 3,633,281 | 1/1972 | Vits . |
| 3,706,475 | 12/1972 | Yakubowski . |
| 3,747,922 | 7/1973 | Groeber . |
| 4,081,201 | 3/1978 | Hassan et al. . |
| 4,131,320 | 12/1978 | Volt et al. . |

OTHER PUBLICATIONS

Apgar et al., "Self-Centering Air Lift Transport", IBM Technical Disclosure Bulletin, vol. 18, No. 7, Dec. 1975, pp. 2141 and 2142.

"Air Film System for Handling Semiconductor Wafers" by J. A. Paivanas & J. K. Hassan, I.B.M. J. Res. Develop., vol. 23, No. 4, Jul., 1979, pp. 361–375.

Research Disclosure Nos. 18434 and 18449.

*Primary Examiner*—Fred L. Braun

*Attorney, Agent, or Firm*—William F. Noval

[57] ABSTRACT

Apparatus for supporting and tentering a flexible member on a layer of a gaseous medium. A support member has an array of passages which exit at a surface and which are arranged in at least two outwardly diverging rows which run obliquely to the path of travel of a flexible member. Channels are provided which run parallel to the rows of passages and each of which has a curved edge adjacent to the row of passages. The passages are oriented to emit gaseous medium in a direction having a component in the direction of travel of the flexible member, a component transverse to and outwardly to tenter the flexible member and a component perpendicular to the member. The gaseous medium is exhausted over the curved edges of the channels in a laminar flow.

9 Claims, 10 Drawing Figures

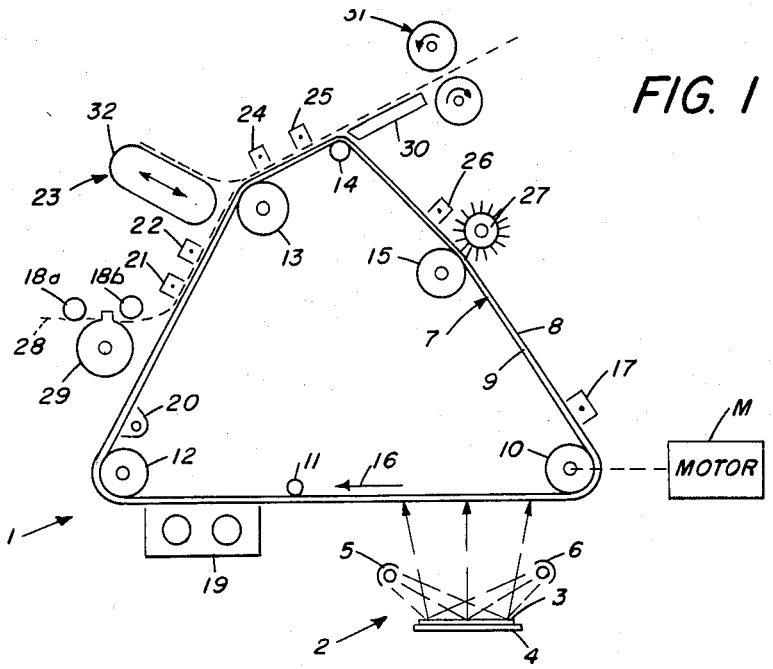
FIG. 1
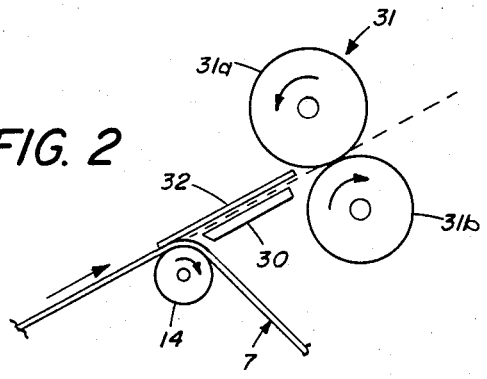
FIG. 2
FIG. 4
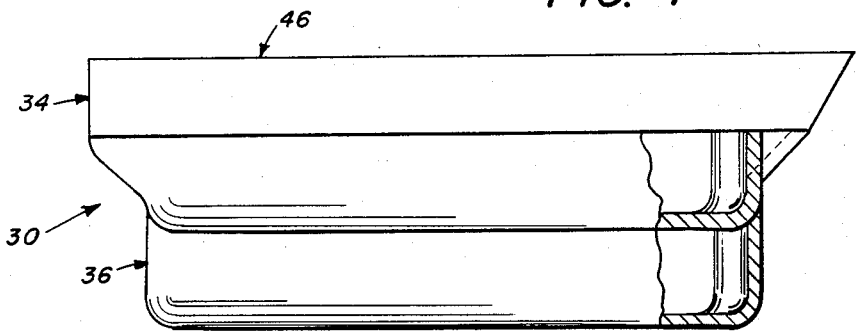

APPARATUS FOR SUPPORTING FLEXIBLE MEMBERS

BACKGROUND OF THE INVENTION

This invention relates to apparatus for supporting a flexible member on a layer of a gaseous medium. More particularly, this invention relates to apparatus for supporting and tentering on a layer of a gaseous medium, a copy sheet having unfixed toner images on one or both sides thereof which is moved between a moving photoconductive member and a fuser.

It is often desirable to support a flexible member moved along a path of travel into or between work stations without physically contacting it. Thus, in electrophotographic copiers, copy sheets carrying unfixed toner images on one or both sides are moved between a photoconductive member and a fusing station at which the unfixed images are fixed to the sheet. If the unfixed toner images are contacted with rollers or conveyors before they are fixed to the copy sheet, the likelihood exists of disturbing the images on the sheet and thereby degrading image quality. It is therefore desirable to support the copy sheet by other than mechanical means. Although copy sheet support techniques utilizing a gaseous medium have been proposed for supporting copy sheets between a photoconductive member or developing means and a fixing station, such techniques have not been successful in handling copy sheets of different weights and sizes where the copy sheet carrying unfused toner images is to be fed into a roller fuser. In such fusers, point of entry of the leading edge of the copy sheet into the fuser roller nip is critical in order to minimize dynamic distortions of the copy sheet which cause image defects.

It is thus desirable that apparatus be provided for supporting copy sheets moved between a photoconductive member and a fixing station in such manner that unfixed toner images on the sheets are not disturbed. The apparatus should be capable of handling copy sheets of different sizes and weights without the necessity of readjusting the apparatus. It is also desirable that the support apparatus be able to deliver the leading edge of the copy sheet in a controlled manner to a precise entry region of a fuser roller nip in order to prevent image defects being produced during the fusing process. To this end the copy sheet should be maintained essentially flat during its movement and be tentered to avoid wrinkles or creases forming before entry into the roller fuser. The support apparatus should be compact, economical, and easily serviced.

SUMMARY OF THE INVENTION

According to the present invention, there is provided apparatus for supporting a flexible member on a layer of a gaseous medium which maintains the flexible member in a flat condition and which is capable of supporting flexible members of different sizes and weights without adjustment of the apparatus. In a preferred embodiment of the apparatus, there is provided means for supporting a flexible member such as a copy sheet having unfixed images above a support surface of said apparatus by means of a gaseous medium. The means for supporting includes an array of passages which exit in such surface and which are arranged in at least two outwardly diverging rows which run obliquely to the path of travel of the copy sheet. The passages are oriented to emit gaseous medium in a direction having a component in the direction of sheet travel, a component transverse to and outwardly of the sheet travel to tenter the sheet and maintain it flat, and a component perpendicular to the sheet's lower surface. The means for supporting is also provided with a plurality of channels which run obliquely to the path of travel of the copy sheet and parallel to the rows of passages and each of which has a curved upper edge adjacent to the passages to exhaust air in a laminar flow.

Preferably, the means for supporting includes means for supplying a gaseous medium to the passages such that gaseous medium is emitted from said holes in a substantially laminar flow over the curved edges of said channels to exhaust thereinto. The laminar flow supports the flexible member a predetermined distance above the support surface as it is moved along the path of travel and holds the sheet down toward the surface. The laminar flow also tenters the sheet outwardly to maintain it in a flat condition.

According to an aspect of the invention, the means for supplying a gaseous medium includes a centrifugal fan mounted below the support surface.

The invention, and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, like numbers indicating like elements in which FIG. 1 is a diagrammatic view of electrographic apparatus including support apparatus according to the present invention;

FIG. 2 is a diagrammatic view of the support apparatus shown in FIG. 1 supporting a copy sheet as it is moved into the nip of a roller fuser;

FIG. 4 is a partially broken away side elevational view of the apparatus of FIG. 2;

DESCRIPTION OF THE PREFERRED EMBODIMENT

Figure 3:
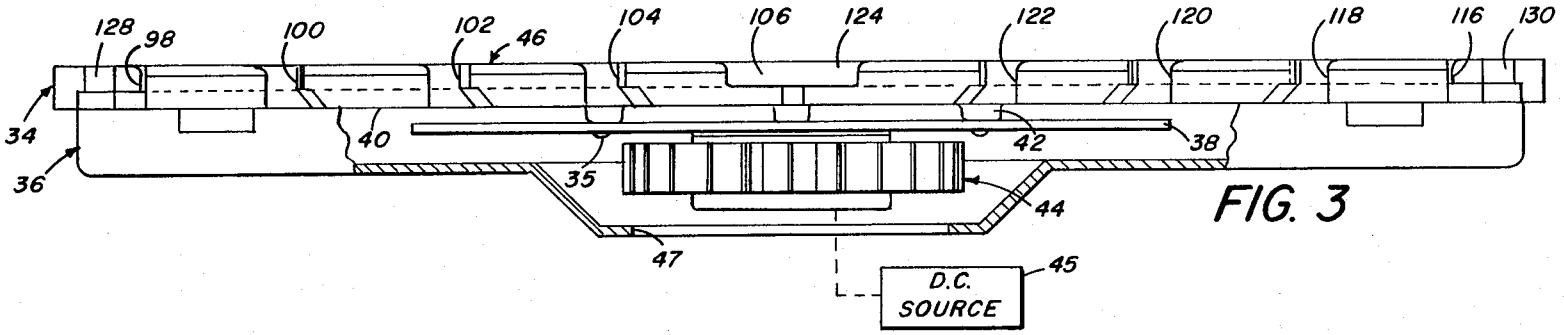
FIG. 3 is a partially broken away front elevational view of the apparatus of FIG. 2.

Referring now to FIG. 1, there is shown electrographic apparatus including a flexible member support apparatus according to the present invention. The electrographic apparatus of FIG. 1 comprises electrophotographic apparatus which is capable of producing images on either one or both sides of a copy sheet processed by the copier. The electrophotographic copier shown is more completely described in commonly assigned U.S. Pat. Nos. 4,095,979 and 4,174,905 and the disclosures thereof are incorporated herein by reference.

As shown in FIG. 1, electrophotographic apparatus 1 (referred to herein as a copier) includes an exposure station 2 at which original documents are positioned to be copied. Documents may be manually fed to station 2 or automatically fed by means of a recirculating feeder such as that disclosed in commonly assigned U.S. Pat. No. Reissue 27,976. A document 3 placed on platen 4 of copier 1 is illuminated by flash lamps 5 and 6 to produce a light image of the document which is projected onto a discreet segment of a photoconductive web 7. Web 7 has a photoconductive or image transfer layer 8 on a conductive layer (not shown) and a transparent support backing 9 and is trained about transport rollers 10, 11, 12, 13, 14, and 15 as an endless or continuous belt. Roller 10 is coupled to a drive Imotor M which drives web 7 in a clockwise direction indicated by arrow 16. Movement of web 7 causes successive sections thereof to move sequentially past a series of electrophotographic work stations.

For the purpose of the instant disclosure, the several work stations along the movement of web 7 may be described as follows:

A charging station including corona charger 17 at which the photoconductive layer 8 of web 7 is sensitized by receiving a substantially uniform electrostatic charge of a first polarity;

An exposure station 2 at which a light image of a document is projected onto photoconductive layer 8 of web 7 to form a latent electrostatic image corresponding to the document by dissipating the electrostatic charge at exposed areas of the photoconductive layer;

A development station including magnetic brush developer 19 at which developing powder including charged toner particles having an electrostatic charge opposite to that of the latent electrostatic image are brushed over the photoconductive layer 8 to cause toner to adhere to the electrostatic image to form a visible transferable unfixed toner image;

A post-development erase station including illumination source 20 at which web 7 is illuminated to reduce photoconductor fatigue;

A first transfer station including first transfer charger 21 at which a first toner image is transferred to the first side of a copy sheet brought into contact with web 7 and a first detack charger 22 which neutralizes the charge on the copy sheet so that it can be easily separated from web 7;

A copy sheet turnover mechanism 23 for turning over a copy sheet while the first toner image is unfixed;

A second transfer station including second transfer charger 24 which transfers a second toner image to the opposite side of a copy sheet and a second detack charger 25 which neutralizes the charge on the copy sheet so that can be separated from web 7 at roller 14; and A cleaning station including charger 26 and cleaning brush 27 which respectively eliminate residual electrostatic charges and toner particles remaining on web 7.

Copier 1 also includes a copy sheet path 28 along which copy sheets are moved such as by rollers 18*a* and 18*b* seriatim to receive toner images from photoconductive web 7. A supply of copy sheets (not shown) is provided from which individual copy sheets are fed along path 28 to registration mechanism 29 which registers copy sheets with toner images formed on web 7. If simplex copies are made, sequential sheets registered by mechanism 29 will receive successive toner images formed on a web 7 at transfer station 21 and be transported along web 7 until they are separated from the belt at roller 14. The copy sheets carrying toner images on the lower sides thereof are then moved over a gaseous medium support apparatus 30 according to the present invention and the unfixed toner images are fixed to the copy sheets by roller fuser 31. The sheets are then transported to an output tray (not shown) or to a copy handling accessory (not shown) such as the finisher described in the above-mentioned U.S. Pat. Nos. 4,095,979 and 4,174,905.

If duplex copies are made, first and second sequential toner images are formed on web 7 by means of the above-mentioned electrophotographic process. A copy sheet is registered by mechanism 29 with the first toner image on web 7 which is then transferred to the first side of the copy sheet by transfer charger 21. After the electrostatic attraction between the copy sheet and web 7 is neutralized by charger 22, vacuum belt 32 of turnover mechanism 23 (moving in a counterclockwise direction) separates the copy sheet from web 7. After the copy sheet is completely separated, the direction of belt 32 is reversed and the second side of the copy sheet is registered with the second toner image on web 7. The second toner image is transferred to the second side of the copy sheet by second transfer charger 24. Second detack charger 25 then neutralizes the electrostatic attraction between the copy sheet and web 7 and the copy sheet separates incrementally from web 7 at roller 14. Web 7 continues to drive the copy sheet carrying unfixed toner images on both sides thereof along path 28 to roller fuser 31 since the sheet has not completely separated from the web. The copy sheet is supported and tentered by gaseous medium support apparatus 30 and is accurately fed into the nip of roller fuser 31 which fuses both images to the copy sheet.

Referring now to FIGS. 2–7, there is shown in detail a copy sheet support apparatus according to the present invention. As shown in FIG. 2, support apparatus 30 is positioned between photoconductive web 7 and roller fuser 31 and supports a copy sheet moved in a path therebetween. As copy sheet 32 separates from web 7 at detack roller 14, the beam strength of sheet 32 causes it to move in a straight path in the direction of roller fuser 31. Since sheet 32 carries unfixed toner images on one or both sides thereof, it is desirable that the sheet be supported by some means which does not disturb these unfixed images before being permanently fixed to the copy sheet by the fuser 31. According to the present invention, a copy sheet support apparatus 30 is positioned to support a copy sheet as it moves between web 7 and fuser roller 31 on a layer of a gaseous medium formed between the copy sheet and an upper surface of the support apparatus.

As shown more particularly in FIG. 3, support apparatus 30 includes an upper member 34, and a lower plenum member 36 to which support member 34 is secured by suitable fasteners such as screws (not shown). A plate 38 is mounted on member 34 by screws 35 and spaced from the lower surface 40 thereof by spacers 42. Centrifugal blower 44 is mounted on plate 38 and is actuated by a suitable electrical source such as a variable DC source 45. Blower 44 rotates to draw a gaseous medium such as air through opening 47 in member 36 into the plenum formed by members 34 and 36.

Figure 5:
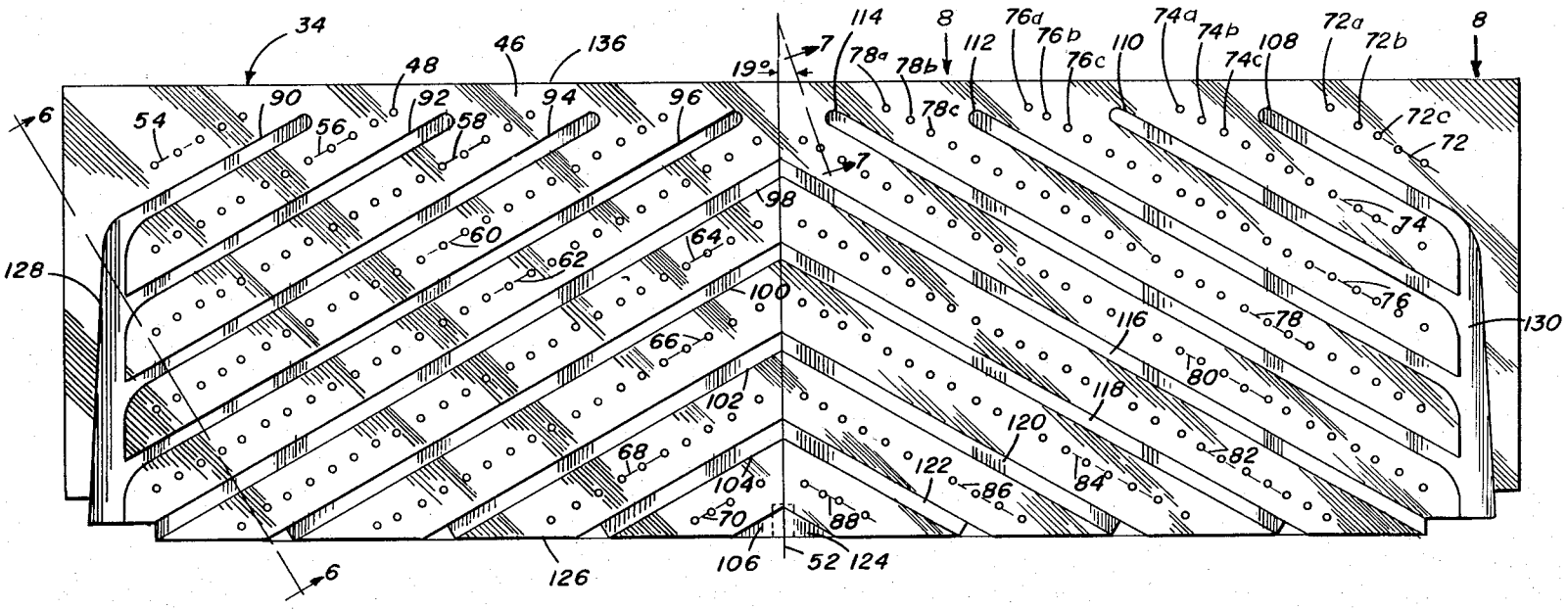
FIG. 5 is a top plan view of the upper member of the apparatus of FIG. 2.

As shown more clearly in FIG. 5, in general, member 34 has an upper surface 46 provided with a plurality of channels running obliquely to the path of travel of a copy sheet over member 34. Member 34 is also provided with an array of passages which extend through the thickness of member 34 at an oblique angle. The passages are arrayed in a plurality of rows which run obliquely to the path of travel of a copy sheet and are positioned parallel to and adjacent to the channels. The longitudinal axes of the passages are preferably parallel in each row but need not be. Each passage is oriented generally forwardly and outwardly of the direction of travel of a copy sheet so that air emitted from the passages tends to move a supported copy sheet in the direction of path of travel and to tenter the copy sheet outwardly to maintain it in a flat condition for accurate delivery to the nip of roller fuser 31.

Figure 7:
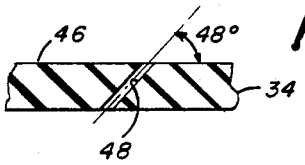
FIG. 7 is a partial sectional elevational view of the upper member taken along line 7—7 of FIG. 5.

As illustrated in more detail in FIGS. 5 and 7, the longitudinal axes of passages 48 extend forwardly and outwardly at a compound angle of, for example, 19° from the centerline of member 34 and of, for example, 48° with the upper surface 47 of member 34. The length of passage 48 is substantially greater than its diameter so that pressurized air is formed into streams of air exiting at surface 46. As shown in FIG. 5, passages 48 are arrayed in a plurality of rows which run obliquely to the path of travel of the copy sheet supported by member 30. The complementary sets of rows on either side of the centerline 52 of member 34 form a chevron-type pattern in surface 46. For example as shown, nine rows of passages, i.e., lefthand rows 54–70 and righthand rows 72–88 are disposed on each side of centerline 52, the rows on one side outwardly diverging in the direction of travel with respect to the rows on the other side. The number of passages in each row varies according to the length of the row but the distance between adjacent passages preferably is the same throughout. Air streams emitted from complementary rows of passages produce a balanced aerodynamic force which tenters the sheet outwardly, supports the sheet above member 34, and tends to urge the sheet in the direction of its travel.

Interleaved with the rows of passages are an array of channels in surface 46 which also form a chevron-type pattern. The air emitted from each row of passages is exhausted into a channel which is located adjacent to and extends parallel to such row. Thus, lefthand rows 54 through 68 exhaust into lefthand channels 90–104, respectively, and right hand rows of holes 72–86 exhaust into righthand channels 108–122, respectively. Rows 70 and 88 exhaust into notches 106 and 124, respectively, in the front wall 126 of member 34. Lefthand channels 98, 100, 102, 104 and righthand channels 116, 118, 120 and 122 have their outlets along the front wall 126 of member 34. Channels 90, 92, 94 and 96 outlet at forwardly extending channel 128 which outlets at wall 126. Similarly, channels 108, 110, 112, and 114 outlet at forwardly extending channel 130 which outlets at wall 126 of member 34.

Figure 8:
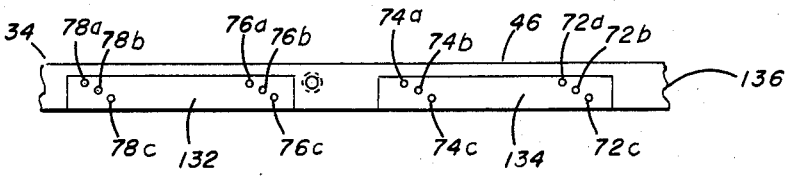
FIG. 8 is a partial elevational view of the upper member taken in the direction of arrows 8—8 of FIG. 5.

The last passages 48 of rows 54–60 and 72–78 have inlets in recesses such as 132 and 134 (FIG. 8) in the rear wall 136 of member 34. Thus, passages 78*a*, 78*b*, 78*c*, 76*a*, 76*b*, and 76*c* have inlets in recess 132 and passages 74*a*, 74*b*, 74*c*, 72*a*, 72*b* and 72*c* have inlets in recess 134.

Figure 6:
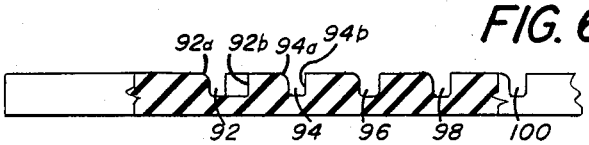
FIG. 6 is an partially sectional elevational view of the upper member taken along line 6—6 of FIG. 5.

As shown in more detail in FIG. 6, channels 90–104 and 108–122 are generally U-shaped in cross section having curved edges 92*a*, 94*a*, etc., adjacent to the rows of passages from which air is exhausted into the channel and straight edges 92*b*, 94*b*, etc., opposite to the curved edge. The effect of the curved edges is to cause airstreams which are emitted from passages 48 against the lower surface of a supported copy sheet to flow in a laminar-type flow along the upper surface 46 of member 34 and along the curved surface of edge 92*a*, 94*a*, etc. into its respective channel. The air is then exhausted towards the front wall 126 of member 34. The airstream emitted from a passage 48 follows a flow pattern which exerts both an uplifting force on the copy sheet and a downwardly holding force thereon to support a copy sheet a predetermined distance above member 34. This distance is a function of the rate of air flow being emitted from passages 48, the angle and dimension of passages 48 and the distance of separation between a row of passages and its adjacent channel.

The pattern of rows of passages and channels of the support apparatus shown in FIGS. 2–7 has been found to provide a support for flexible members (such as copy sheets carrying unfused toner images) which vary in size and weight without the necessity of changing the nature of the air flow emitted from the passages. Thus, copy sheets of different sizes and weights are maintained essentially flat at a predetermined distance above the surface of apparatus 34 as they are moved thereover. In this manner, a flexible member may be delivered to a precise region of a work station. In the feeding of copy sheets carrying unfixed toner images into the nip of a roller fuser, it has been found desirable to accurately control the delivery of the copy sheet to the nip of the fuser roller in order to avoid the creation of image defects during the fusing process. The support apparatus of the present invention described herein effects such precise delivery.

The pattern of obliquely extending rows of passages and channels of the support apparatus of the present invention obviates the necessity for adjusting the apparatus to accomodate copy sheets' different sizes and weights. It has been found that if the air emitted against the lower surface of a copy sheet is exhausted into channels which run longitudinally along the surface of the support apparatus in directions parallel to the path of travel of the copy sheet, the spacing between the upper surface of the support apparatus and the copy sheet varies as a function of the size and weight of the copy sheet. If the copy sheet is to be delivered to a predetermined region of the nip of a roller fuser, then the nature of the air flow would have to be changed for each change in the size or weight of the copy sheet to be supported. This same condition was also found to exist where the air emitted from the passages is exhausted into channels which extend perpendicularly or cross-track to the direction of a copy sheet. Moreover, cross-track channels tend to create oscillatory motions in the copy sheet which may disturb the unfixed toner images on the copy sheet and cause a loss of control of the leading edge of the copy sheet and consequently, improper nip entry into the roller fuser. Although the orientation of the channels and rows of passages in the support apparatus of the present invention is generally not critical, for best results they should not be either parallel or perpendicular to the copy sheet path of travel.

The angle of the passages exiting from the upper surface of the support apparatus generally should be chosen to optimize airflow characteristics to provide the lifting and holddown forces which maintain the copy sheet in a flat condition at a predetermined distance above such surface. The airflow should be such that toner images are not disturbed. Generally, the passages should not be perpendicular to the support surface since air emitted from such passages provide lifting forces but not holddown forces making the support apparatus sensitive to the weight of the copy sheet.

Additionally, the passages should not be angled towards each other as emitted air tends to flutter the copy sheet and cause wrinkles in it. Angling of the passages in the direction of travel of the copy sheet creates airflows which assist in accurately positioning the copy sheet at the desired inlet region of the fuser roller. Such airflows may also be used as the source of motive drive for the copy sheet. In the embodiment shown and described herein, the driving force for the copy sheet is basically provided by photoconductive web 7 before entry into the fuser nip and by the roller fuser after entry into the fuser nip.

Upper member 34 of apparatus 30 may be formed of any material such as plastic, metal, wood or the like. The passages formed in upper member 34 may be drilled into the member or the passages may be molded in plastic material. Channels 46 may be molded into plastic material or be formed by other mechanical, chemical or electrical means. The cross-sectional shape of channels 46 may be other than that shown in the figures. For example, instead of having flat lower or side walls, the walls may be in the form of semi-elipses, semi-circles, or the like. The diameter and length of passages 48 may also be varied as long as they produce the desired airflow effects referred to above.

In order to effect a substantially uniform static pressure in the plenum chamber formed by members 34 and 36 at the inlets to passages 48, it is preferable to use a centrifugal fan as a source of the pressure. Such fans are compact, permitting the support apparatus to be compact. They are also economical and produces a uniformly distributed force to act on the sheet. As shown in FIG. 3, fan 44 is mounted below plate 38 which acts as a baffle for air emitted.from fan 40 to the passages which have inlets adjacent to plate 38. Preferably, the centrifugal fan 44 is powered by a variable direct current source such as source 45 so that the air velocity emitted from passages 48 can be varied. Thus, variation of the parameters of the airflow may be easily effected. An air velocity exiting passages 48 in the range of 1,000 feet to 1,200 feet per minute provides a suitable support for copy sheets in the 13-pound to 32-pound range.

Figure 9:
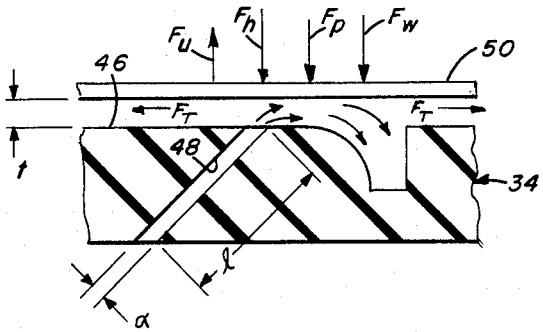
FIG. 9 is a schematic diagram illustrating the forces acting on a supported flexible member.

Referring now to FIG. 9, there is schematically shown the dynamic forces produced by air emitting from passages 48 in support apparatus 30. As shown, passages 48 have a diameter d and a length l.

The forces acting to maintain a flexible member such as a copy sheet 50 a predetermined distance t above the surface 46 of member 34 is a function of (1) the force created by the airstream emitted from hole 48 called the uplift force $F_u$; (2) the force on the paper produced by atmospheric pressure or $F_p$; and (3) the force produced by the weight of the paper $F_w$. In addition, the airstream emitting from the hole 48 tends to separate itself from the upper surface 46 of member 34 causing a decrease in pressure in the region adjacent the outlet of hole 48 on surface 46. The effect is to produce a holddown force $F_H$ which is applied to the copy sheet in the region of hole 48 by curving the edge of channel 46 adjacent to the outlet of hole 48. The stream of air follows the channel's curved surface to extend the region of low pressure and therefore to extend the region that the holddown force is exerted on the copy paper. Forces $F_T$ are also produced to tenter the sheet outwardly. The combined effects of all these forces produce the desired results of maintaining the copy sheet in a flat condition across the width of the support apparatus 30 while precisely holding the copy sheet at a predetermined distance above the support apparatus so that the leading edge of a copy sheet may be accurately delivered to the fuser roller nip.

Figure 10:
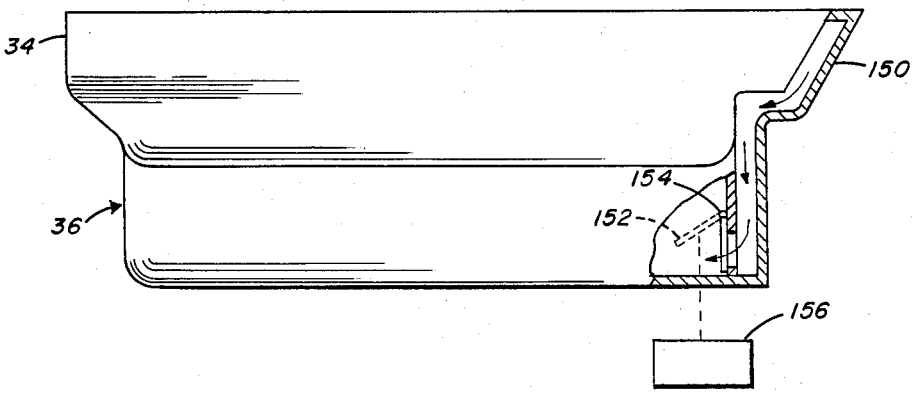
FIG. 10 is a modification of the embodiment of FIG. 2.

Referring now to FIG. 10, there is shown a modification of a support apparatus of the present invention. As shown, air from channels 128, 98, 100, 102, 104, 116–122, 130 and notches 106 and 124 (FIG. 5) exhaust into a laterally extending sump to feed the air back to the inlet of the centrifugal fan. In the embodiment shown this is effected by providing a wall 150 forwardly of the front edges of members 34 and 36 and extending downwardly and inwardly to form a channel for the exhausted air into the inlet vent for fan 44. A movable gate 152 is provided in the channel formed by wall 150 in order to control the amount of air fed back. In this manner, the distance between the copy sheet and the upper surface of apparatus 30 may be varied in a simple and effective manner. Gate 152 is rotatably mounted at pivot 154 and is moved by means of a solenoid 156.

It is thus seen that a support apparatus for flexible members such as copy sheets carrying unfixed toner images is provided which maintains the copy sheet in a flat tentered orientation and which supports the member a predetermined distance above the upper surface of the support apparatus to thereby control the region at which a member may be delivered to a workstation such as the nip of a roller fuser. The support apparatus is simple in design, economical and compact and may be supported in electrophotographic apparatus for easy insertion and removal for adjustment and servicing. The support apparatus is adapted to support flexible members of different sizes and weights at a predetermined distance above the support surface without the necessity of adjusting the apparatus. In a modified embodiment, exhausted air is fed back to the inlet of the fan in order to provide a simple control for the inlet pressure.

The invention has been described in detail with particular reference to preferred embodiments thereof but it will be understood that variations and modifications can be effected within the spirit and scope of the invention.

I claim:

1. Apparatus for supporting a copy sheet which is subject to wrinkling as it is moved along a path to a work station comprising:

a support member having a surface disposed in spaced parallel facing relationship to said path;

said support member having a plurality of passages with openings at said surface;

said passages being arrayed in at least first and second rows (1) which are symmetrically positioned with respect to each other on opposite sides respectively across the width of said path, (2) which extend obliquely to said path and (3) which diverge in the direction of movement of such copy sheet along said path, said passages of said first row diverging from said passages in said second row and from the direction of movement of such copy sheet along said path;

said support member further having at least (1) a first channel in said surface which is located along the path of movement of such copy sheet and which extends obliquely to said path and substantially parallel and adjacent to said first row of passages, and (2) a second channel in said surface which is located along the path of movement of such copy sheet and which extends obliquely to said path and substantially parallel and adjacnet to said second row of passages, each said channel having a curved edge adjacent to its respective row of passages at said surface; and means for supplying a pressurized gaseous medium to said passages to effect a laminar flow of gaseous medium from said openings of said passages at said surface along said surface, and into said channels to be exhausted thereby outwardly with respect to said path, said flow of gaseous medium (1) supporting copy sheets of different sizes and weights at a predetermined height above said surface; (2) tentering said sheet outwardly to prevent wrinkling and creasing thereof as it is moved along said path; and (3) delivering the leading edge of a supported sheet to a precise region of a work station.

2. Apparatus for supporting a copy sheet carrying an unfused toner image which is subject to wrinkling as it is moved along a path to a fixing station, comprising:

a support member located adjacent to said fixing station and having a surface extending along the path of movement of a copy sheet carrying an unfused toner image;

said support member having a plurality of passages with openings at said surfaces, said passages being arrayed in at least first and second rows (1) which are positioned with respect to each other on opposite sides across the width of said path, (2) which extend obliquely to said path, and (3) which diverge in the direction of said path, said respective passages of said first and second rows being oriented in an outward direction and in the direction of said path, said support member further having at least (1) a first channel in said surface which is located along said path and which extends obliquely to said path and substantially parallel and adjacnet to said first row of passages and (2) a second channel in said surface which is located along said path and which extends obliquely to said path and substantially parallel and adjacent to said second row of passages, each of said channels having a curved edge adjacent to its respective row of passages, and means for supplying a pressurized gaseous medium to said passages to effect a laminar flow of gaseous medium from said openings of said passages at said surface, along said surface and into said channels to be exhausted thereby outwardly with respect to said path, said flow of gaseous medium (1) supporting copy sheets of different sizes and weights at a predetermined height above said surface; (2) tentering a supported sheet outwardly to prevent wrinkling and creasing thereof as it is moved along said path; and (3) delivering the leading edge of a supported sheet to a precise region of said fusing station.

3. The apparatus of claim 2 wherein said plurality of passages in said support member extend through said member and have inlet openings and wherein said means for supplying supplies a gaseous medium under pressure to said inlet openings.

4. The apparatus of claim 3 wherein said support member includes means for defining a plenum chamber below said inlet openings to said passages and wherein said means for supplying includes a centrifugal fan mounted in said plenum chamber and adapted to supply gaseous medium to the inlet openings of all of said passages at a substantially uniform pressure.

5. The apparatus of claims 1, 2, 3, or 4 including means for feeding gaseous medium exhausted into said at least first and second channels back to said passages for emission therefrom.

6. In electrographic apparatus including an image transfer member upon which transferable unfixed images are formed, fixing means including a pair of rollers forming a nip spaced from said image transfer member for fixing images to a copy sheet and means for defining a path along which copy sheets are moved to receive unfixed images from said transfer member and to have said images fixed by said fixing means as they pass through said roller nip, copy sheet support apparatus comprising:

means, located along said path between said image transfer member and said fixing means, for supporting a copy sheet moved between said transfer member and said fixing means, said supporting means having a support surface adjacent to said path;

means for defining a plurality of passages in said means for supporting, said plurality of passages having outlet openings at said surface and being arranged in at least two rows on respective opposite sides across the width of said path run and running obliquely to the path of travel of said copy sheet, said passages being angled forwardly and outwardly in the direction of copy sheet travel;

means for defining at least first and second channels in said support surface of said supporting means, said first and second channels running obliquely and outwardly to the path of travel of said copy sheet and respectively parallel to and adjacent to said first and second rows of passages, each said channel having a curved edge adjacent to said passages; and means for supplying a pressurized gaseous medium to said passages such that said medium is emitted from said outlet openings in a substantially laminar flow along said surface and over said curved edges into said channels to be exhausted thereby outwardly with respect to said path, said laminar flow of gaseous medium (1) supporting copy sheets of different sizes and weights at a predetermined height above said surface; (2) tentering said copy sheet outwardly to prevent wrinkling and creasing thereof as it is moved along said path; and (3) delivering the leading edge of a supported sheet to a predetermined region of the nip of said fuser rollers.

7. The apparatus of claim 6 wherein said means for supporting includes (1) a support member having said support surface and in which said passages have outlet openings at said support surface and have inlet openings; and (2) means for defining a plenum chamber communicating with said inlet openings and wherein said means for supplying includes a centrifugal fan mounted in said plenum chamber for supplying a gaseous medium under pressure to all of said inlet openings of said passages in a uniform manner.

8. The apparatus of claim 7 wherein said centrifugal fan is powered by direct current and including means for applying a selectively variable direct current to said centrifugal fan for selectively varying the pressure of gaseous medium supplied to said inlet openings of said passages.

9. The apparatus of claims 6 or 7 including means for feeding gaseous medium exhausted into said channels back to said passages for emission therefrom.

* * * * *